US008644743B2

(12) United States Patent
Ruiz et al.

(10) Patent No.: US 8,644,743 B2
(45) Date of Patent: Feb. 4, 2014

(54) METHOD AND APPARATUS TO IMPROVE BELT ROLL FUSING STRIPPING LATITUDE BY STRIP SHOE POSITION ADJUSTMENT

(75) Inventors: Erwin Ruiz, Rochester, NY (US); Augusto E. Barton, Palo Alto, CA (US); Rebecca M. Hainley, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 317 days.

(21) Appl. No.: 13/160,022

(22) Filed: Jun. 14, 2011

(65) Prior Publication Data

US 2012/0321359 A1 Dec. 20, 2012

(51) Int. Cl.
*G03G 15/20* (2006.01)

(52) U.S. Cl.
USPC ..... 399/323

(58) Field of Classification Search
USPC ..... 399/322, 323
See application file for complete search history.

(56) References Cited

U.S. PATENT DOCUMENTS

| | | | | |
|---|---|---|---|---|
| 5,138,178 | A | 8/1992 | Wong et al. | |
| 7,633,647 | B2 | 12/2009 | Mestha et al. | |
| 7,817,950 | B2 | 10/2010 | Burton et al. | |
| 8,331,818 | B2 * | 12/2012 | Berg et al. | 399/67 |
| 8,478,148 | B2 * | 7/2013 | Nakatsuhara et al. | 399/45 |
| 8,478,177 | B2 * | 7/2013 | Kurita et al. | 399/323 |
| 2007/0065189 | A1 * | 3/2007 | Miyata et al. | 399/323 |
| 2007/0177913 | A1 | 8/2007 | Russel et al. | |
| 2010/0129096 | A1 | 5/2010 | DeGruchy | |
| 2011/0026985 | A1 | 2/2011 | Barton | |

* cited by examiner

*Primary Examiner* — Walter L Lindsay, Jr.
*Assistant Examiner* — Frederick Wenderoth
(74) *Attorney, Agent, or Firm* — Ronald E. Prass, Jr.; Prass LLP

(57) ABSTRACT

According to aspects of the embodiments, there is provided apparatus and methods of improving the self-stripping capabilities of a printing system employing a belt roll fuser structure. An exemplary embodiment apparatus comprises a pressure roll; a fuser belt; a nip formed by the fuser belt contacting the pressure roll, the nip including an inlet end where a medium enters the nip, an outlet end where the medium exits the nip, and a first nip width defined between the inlet end and the outlet end; and a striping shoe coupled to a controller that uses a lookup table to incrementally move the stripping shoe to some defined optimum position to compensate for at least one of belt degradation, media weight, and media coating to gain stripping latitude.

20 Claims, 7 Drawing Sheets

METHOD AND APPARATUS TO IMPROVE BELT ROLL FUSING STRIPPING LATITUDE BY STRIP SHOE POSITION ADJUSTMENT

BACKGROUND

Disclosed herein are methods and apparatus for a printing system that includes a fusing member and a pressure member. More particularly, the disclosure relates to improved self-stripping of a print media from the fusing member as the media leaves a nip formed between the fusing member and pressure member.

In the art of xerography or other similar image reproducing arts, a latent electrostatic image is formed on a charge-retentive surface, i.e., a photoconductor or photoreceptor. To form an image on the charge-retentive surface, the surface is first provided with a uniform charge, after which it is exposed to a light or other appropriate image of an original document to be reproduced. The latent electrostatic image thus formed is subsequently rendered visible by applying any one of numerous toners specifically designed for this purpose.

In a typical xerographic device, the toner image formed is transferred to an image receiving media such as paper. After transfer to the image receiving media, the image is made to adhere to the media using a fuser apparatus. To date, the use of simultaneous heat and contact pressure for fusing toner images has been the most common system that utilizes a pair of pressure-engaged rolls. At the time of initial set-up of a xerographic device, the fuser system is set to be within certain specifications for nip width, media velocity and deformation of rolls and fusing belt or creep.

Nip width is one of the more significant drivers of image fix and quality. Media velocity is an important factor in paper handling. Deformation or creep, which is the release surface's extension in the nip, is important with respect to enabling the stripping of the paper from the fusing belt in a fusing system. It is known that higher magnitudes of creep are effective in improving the self-stripping capabilities of the fuser system over wide latitude of substrate media. Unfortunately, higher magnitudes of creep also mean higher levels of strain energy in the fuser roll materials when in the nip vicinity, thereby shortening the longevity of the belt and rolls and impacting print quality.

Additionally, usage of the belt and rolls in the course of normal printing activities causes contamination and increases the coefficient of friction between the rolls and the belt. This increase in the coefficient of friction reduces the self-stripping capabilities of the roll belt system over wide latitude of print media.

For the reasons stated above, and for other reasons stated below which will become apparent to those skilled in the art upon reading and understanding the present specification, there is a need in the art for an improved method and apparatus for improving the self-stripping capabilities of a belt roll fuser system in a printing system.

SUMMARY

According to aspects of the embodiments, there is provided apparatus and methods of improving the self-stripping capabilities of a printing system employing a belt roll fuser structure. An exemplary embodiment apparatus comprises a pressure roll; a fuser belt; a nip formed by the fuser belt contacting the pressure roll, the nip including an inlet end where a medium enters the nip, an outlet end where the medium exits the nip, and a first nip width defined between the inlet end and the outlet end; and a striping shoe coupled to a controller that uses a lookup table to incrementally move the stripping shoe to some defined optimum position to compensate for at least one of belt degradation, media weight, and media coating to gain stripping latitude.

DETAILED DESCRIPTION

Figure 1:
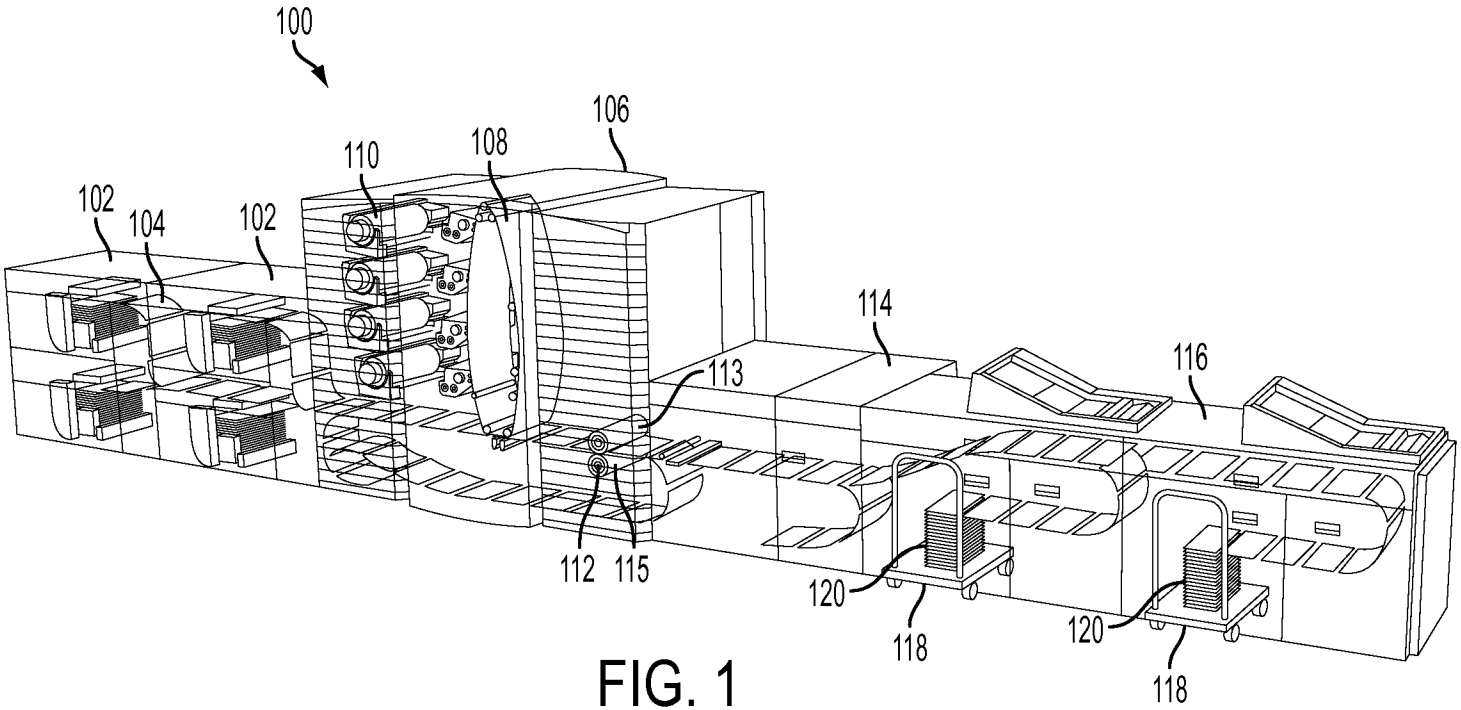
FIG. 1 depicts an exemplary embodiment of a printing apparatus in accordance to an embodiment.

Aspects of the embodiments disclosed herein relate to methods for improving self stripping latitude associated with fusing members in a printing system, and corresponding apparatus. The disclosed embodiments uses a control mechanism to move the stripping shoe to some defined optimum increment or step to regain the paper stripping latitude. This incremental movement of the stripping shoe changes the position of the belt affecting the wrap angle to the pressure roll and the stripping angle enabling improved strip latitude overall.

The disclosed embodiments include fusing system useful in a printing apparatus having a first member including a first outer surface; a second member including a second outer surface; a belt including an inner surface and an outer surface, wherein a first nip having a first nip width is formed by contact between the inner surface of the belt and the first outer surface and contact between the outer surface of the belt and the second outer surface; a stripping mechanism comprising a stripping shoe disposed internal to the belt, wherein the stripping shoe is positionable relative to the first nip to vary contact between the outer surface of the belt against the second outer surface downstream from the first nip, wherein media are stripped from the belt after exiting from the first nip and wherein the contact between the outer surface of the belt against the second outer surface forms a second nip width adjacent to the first nip; and a controller applying an algorithm to incrementally move the stripping shoe to adjust the contact between the outer surface of the belt against the second outer surface downstream from the first nip so as to compensate for at least one of belt degradation, media weight, and media coating; wherein the incremental movement of the stripping shoe changes the second nip width to improve self stripping latitude associated with the first member, the second member, and the belt.

The disclosed embodiments further include a method of stripping media from a surface in a printing system by performing feeding a medium having marking material thereon to a first nip, the first nip being formed by a first surface of a first member and an inner surface of a belt rotatably supported on a second surface of a second member, the medium contacting the second surface and the outer surface of the belt at the first nip; adjusting through a stripping shoe a second nip width formed adjacent to the first nip by contact between the outer surface of the belt against the second outer surface, wherein the adjustment moves the stripping shoe towards the first nip so as to compensate for at least one of belt degradation, media weight, and media coating; and selectively changing the second nip width in response to a defined signal from a controller applying an algorithm; wherein changing the second nip width improves self-stripping latitude associated with the first member, the second member, and the belt.

The disclosed embodiments further include a method of stripping media from a surface in a printing system wherein applying the algorithm comprises accessing a lookup table that correlates the at least one of belt degradation, media weight, and media coating to the second nip width.

The disclosed embodiments further include a method of stripping media from a surface in a printing system wherein the first nip includes an inlet where media enter the first nip and an outlet where the media exit the first nip.

The disclosed embodiments further include a method of stripping media from a surface in a printing system wherein the second nip width formed by the stripping shoe is adjacent to the outlet of the first nip.

The disclosed embodiments further include a method of stripping media from a surface in a printing system wherein the controller receives signals from a sensor that detects media weight and media coating to move the stripping shoe from a first position to a second position according to the lookup table.

The disclosed embodiments further include a method of stripping media from a surface in a printing system wherein the second nip width is adjusted within a range of about 1 mm to about 12 mm.

The disclosed embodiments further include a method of stripping media from a surface in a printing system wherein the incremental movement of the stripping shoe is increased for media weight lower than a predetermined media weight and decreased for uncoated media.

The disclosed embodiments further include an apparatus useful for printing having a first pressure roll including a first outer surface; a second pressure roll including a second outer surface; a heated belt including an inner surface and an outer surface; a first nip formed by contact between the outer surface of the belt and the second outer surface and contact between the inner surface of the belt and the first outer surface, the first nip including an inlet where media enter the first nip and an outlet where the media exit the first nip; and a stripping mechanism comprising a motor; a stripping shoe connected to the motor and disposed internal to the belt, wherein the motor is operable to position the stripping shoe relative to the first nip to vary contact between the outer surface of the belt against the second outer surface downstream from the outlet of the first nip, wherein the contact between the outer surface of the belt against the second outer surface forms a second nip width adjacent to the first nip; and a controller to selectively control the motor using an algorithm based on belt and media properties to incrementally move the stripping shoe to adjust the contact between the outer surface of the belt against the second outer surface downstream from the first nip.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. The computer-readable media store instructions that may be executed by a processor to perform various functions. For example, the computer-readable media may store instructions for ensuring that a stripping shoe is positioned to increase the self-stripping latitude of a printing system by performing the methods illustrated in FIG. 6 and FIG. 7.

The term "printing device" or "printing system" as used herein refers to a digital copier or printer, scanner, image printing machine, digital production press, document processing system, image reproduction machine, bookmaking machine, facsimile machine, multi-function machine, or the like and can include several marking engines, feed mechanism, scanning assembly as well as other print media processing units, such as paper feeders, finishers, and the like. A "printing system" can handle sheets, webs, marking materials, and the like. A printing system can place marks on any surface, and the like and is any machine that reads marks on input sheets; or any combination of such machines.

The term "print media" generally refers to a usually flexible, sometimes curled, physical sheet of paper, plastic, or other suitable physical print media substrate for images, whether precut or web fed.

The term "belt degradation" as used herein refers to a reduction in the functionality of a belt due to wear and contamination. The belt degradation is proportional to how long the belt has been in use; i.e. the belt age.

The term "self-stripping latitude" as used herein refers to the release of the print media without the aide of one or more stripping device like air-knife, stripping fingers or the like located in the post-nip region.

FIG. 1 illustrates an exemplary printing apparatus 100 disclosed in U.S. Pat. No. 7,633,647 (Meshta et al.), which is incorporated herein by reference in its entirety. The printing apparatus 100 includes two media feeder modules 102 arranged in series, a printer module 106 adjacent the media feeder modules 102, an inverter module 114 adjacent the printer module 106, and two stacker modules 116 arranged in series adjacent the inverter module 114. In the printing apparatus 100, the media feeder modules 102 feed media to the printer module 106. In the printer module 106, toner is transferred from a series of developer stations 110 to a charged photoreceptor belt 108 to form toner images on the photoreceptor belt 108 and produce prints. The toner images are transferred to respective media 104 fed through the paper path. The media are advanced through a fuser 112 including a fuser roll 113 and a pressure roll 115, which form a nip where heat and pressure are applied to the media to fuse toner images onto the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Apparatuses useful in printing, fixing devices and methods of stripping media in apparatuses useful in printing are provided. The apparatuses are constructed to allow different types of marking material to be treated on different types of media. The apparatuses include a belt. The belt can be heated to supply thermal energy to media contacting the belt. The apparatuses are constructed to allow different types of media to be stripped from the belt.

Figure 2:
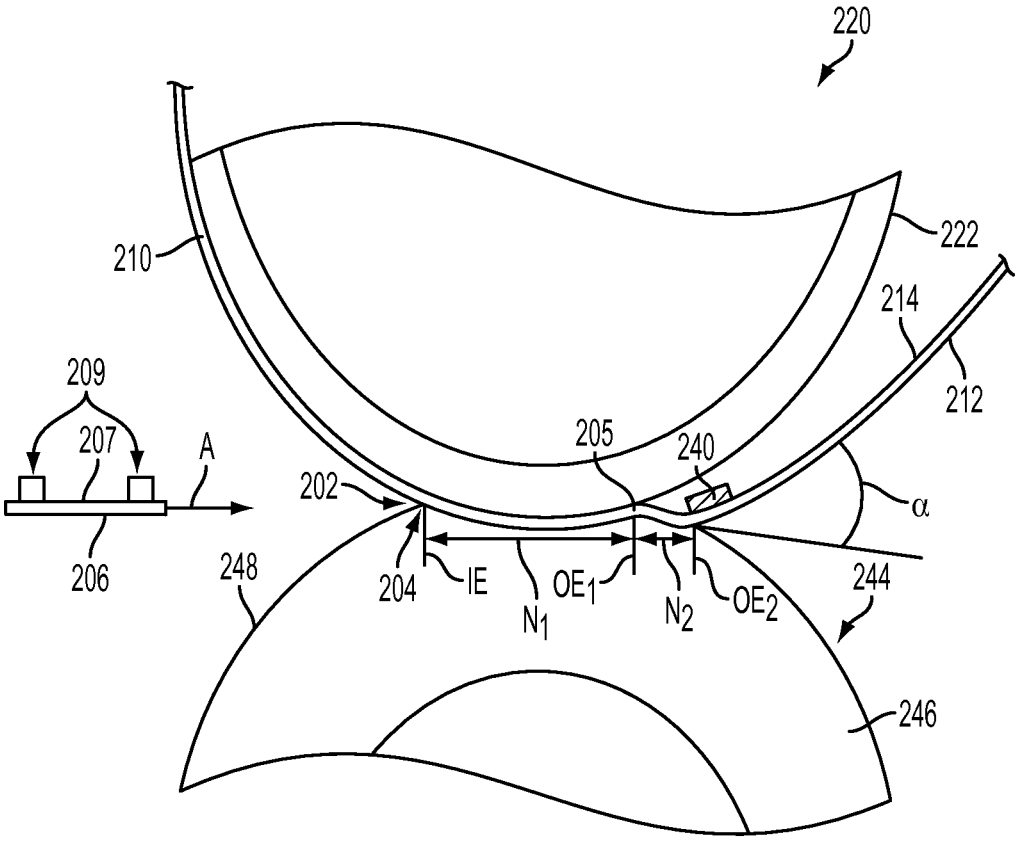
FIG. 2 depicts an exemplary embodiment of a fuser system including a stripping shoe and nip region in accordance to an embodiment.

FIG. 2 depicts an exemplary embodiment of a fuser system including a stripping shoe and nip region in accordance to an embodiment. Embodiments of the apparatuses useful in printing can include a fixing device. FIG. 2 illustrates an exemplary embodiment of a fuser constructed to fix marking materials onto media. Embodiments of the fuser can be used in different types of printing apparatuses. For example, the fuser can be used in place of the fuser 112 in the printing apparatus 100 shown in FIG. 1.

FIG. 2 depicts a medium 206 being fed 204 to the nip 202 in the process direction A. The medium 206 includes a surface 207 on which marking material 209 (e.g., toner) is present. The fuser system includes an external pressure roll 244 having an outer layer 246 with an outer surface 248. In embodiments, the outer layer 246 is comprised of an elastically deformable material, such as silicone rubber, perfluoroalkoxy (PFA) copolymer resin, or the like. The internal pressure roll 220 includes outer surfaces contacting the inner surface 214 of the belt 210. The external pressure roll 244 includes an outer surface 248 contacting the outer surface 212 of the belt 210.

The surface 207 and marking material 209 contact the outer surface 212 of the belt 210 at the nip 202. The nip 202 is also referred to herein as the "first nip." As shown, the nip 202 includes a first nip ($N_1$) that extends between an inlet end, IE, and an outlet end OE1 downstream from the inlet end IE. Media are fed 204 to the inlet end IE and exit 205 at the outlet end OE1. In embodiments, the internal pressure roll 220 is rotated counter-clockwise, and the external pressure roll 244 is rotated clockwise, to convey the medium 206 through the first nip 202 in the process direction A and rotate the belt 210 counter-clockwise.

The medium 206 can be a sheet of paper, a transparency or packaging material, for example. Paper is typically classified by weight, as follows: lightweight: L.T. (≤) 75 gsm, mid-weight: about 75 gsm to about 160 gsm, and heavyweight: G.T. (≥) 160 gsm. For toner, a low mass is typically less than about 0.8 g/cm.sup.2. The medium 206 can be, e.g., light-weight paper, and/or the marking material 209 can have a low mass, or the medium 206 can be a heavy-weight type, e.g., heavy-weight paper or a transparency, and/or the marking material 209 can have a high mass (e.g., at least about 0.8 g/cm.sup.2). A larger amount of energy (both per thickness and per basis weight) is used to treat marking material (e.g., fuse toner) on coated media than on uncoated media. The fuser may further includes a stripping mechanism (not shown) for stripping media from the outer surface 212 of the belt 210 after the media exit from the first nip 202 traveling in the process direction A.

The first nip $N_1$ is a high-pressure region at which thermal energy and pressure are applied to treat marking material on media. For example, toner can be fused on media by heating the media to at least the toner fusing temperature at the first nip $N_1$.

FIG. 2 further includes a second nip, $N_2$, adjacent the first nip $N_1$. The second nip $N_2$ extends from about the outlet end $OE_1$ of the first nip $N_1$ to an outlet end $OE_2$, which is downstream from the outlet end $OE_1$. The belt 210 diverges from the outer surface of the external pressure roll 244 at the outlet end $OE_2$. A stripping shoe 240 is located downstream from the outlet end $OE_2$ of the second nip $N_2$. Media are stripped from the outer surface 212 of the belt 210 adjacent to the stripping shoe 240. The stripping shoe 240 is located sufficiently close to the outlet end $OE_1$ of the first nip $N_1$ to allow cleaning of contaminants immediately after exiting the first nip $N_1$. Further, the stripping shoe 240 is fixedly coupled to a motor and controller, and attached to a bracket (not shown), such as by welding, fasteners, adhesive bonding, or the like.

At the location of the stripping shoe 240, the fuser belt 210 bends at a stripping angle, α, further away from the outer surface 222 of internal pressure roll 220. The stripping angle α can typically be from about 15° to about 90°.

In the fuser system, the stripping shoe 240 is subjected to a side load from tension in the belt 210. The side load acts in a direction toward the internal pressure roll 220 or fuser roll. The stripping shoe 240 is tensioned to limit the magnitude of the deflection (or sag) of the stripping shoe 240 resulting to side load from the belt 210. Degradation of the belt 210 due to contamination and aging causes the belt to move away from external pressure roll 244 reducing the second nip ($N_2$) and reducing self-stripping latitude. By moving the stripping shoe 240, the stripping shoe 240 and belt 220 are kept from contacting the internal pressure roll 220 and un-forming or reducing the second nip $N_2$.

Figure 3:
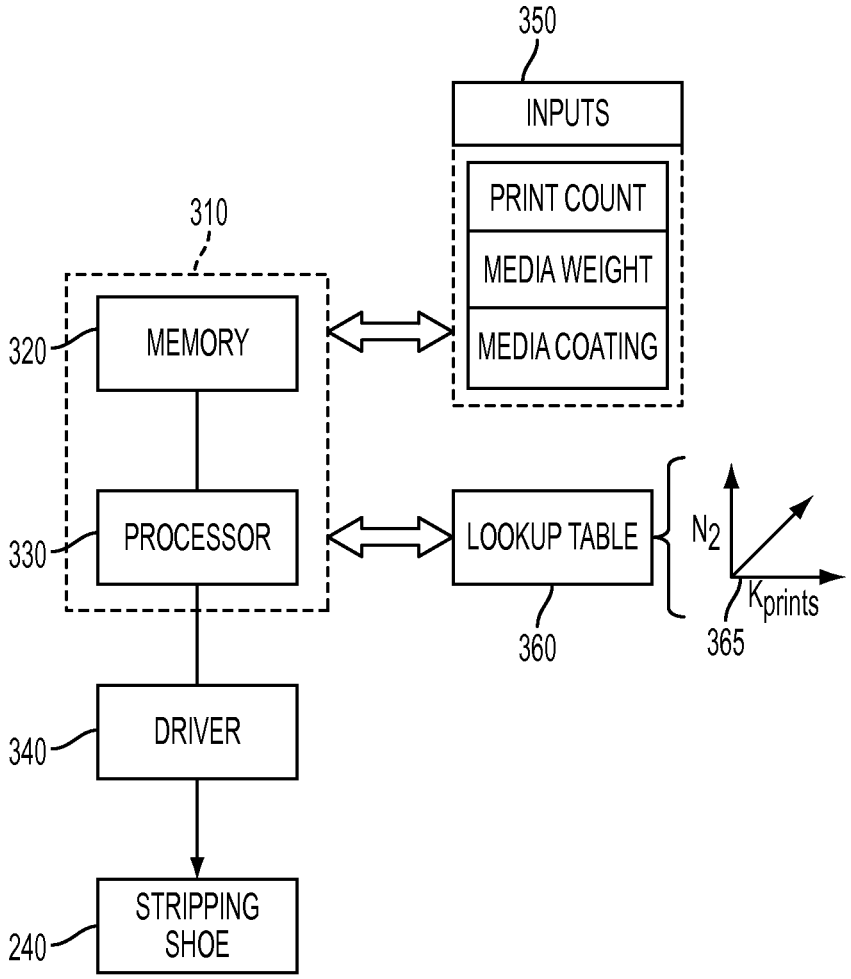
FIG. 3 depicts a block diagram of a controller with lookup table that may be used to improve self stripping latitude of a printing system in accordance to an embodiment.

FIG. 3 depicts a block diagram of a controller with lookup table that may be used to improve self stripping latitude of a printing system in accordance to an embodiment.

The stripping shoe controlling system consists of a controller 310, a power driver circuit 340 circuitry for supplying electrical current to motion device such as a motor, and a stripping shoe 240 for applying a force to the belt 210. The function of the controller could be performed by machine controller (not shown) found in printing system 100. As shown in FIG. 2, a separate controller could be employed provided that a processor 330 and a memory 320 are included to perform in combination the data processing.

Processor 330 may include at least one conventional processor or microprocessor that interprets and executes instructions. The processor 330 may be a general purpose processor or a special purpose integrated circuit, such as an ASIC, and may include more than one processor section. Additionally, the controller 310 may include a plurality of processors 330.

Memory 320 may be a random access memory (RAM) or another type of dynamic storage device that stores information and instructions for execution by processor 330. Memory 320 may also include a read-only memory (ROM) which may include a conventional ROM device or another type of static storage device that stores static information and instructions for processor 330. The memory 320 may be any memory device that stores data for use by controller 310.

The controller 310 may perform functions in response to processor 330 by executing sequences of instructions or instruction sets contained in a computer-readable medium, such as, for example, memory 320. Such instructions may be read into memory 320 from another computer-readable medium, such as a storage device, or from a separate device via a communication interface, or may be downloaded from an external source such as the Internet (not shown). The system may be a stand-alone system, such as a personal computer, or may be connected to a network such as an intranet, the Internet, and the like. Other elements may be included with the system as needed. A power driver circuit 340, which furnishes both power, and control signals for incrementally moving the stripping shoe to an optimal position for stripping latitude.

Constraints may be placed by the system or the user and entered via a suitable interface at printing system 100 or controller 310. Example of user interface is a built-in user interface which includes a display, keyboard or a touch screen, or other user input device. System constraints reading the data that is retained within a CRUM at a particular time, certain use characteristics of the replaceable module or can be derived from CRUM data. As an example, the CRUM memory stores the end of life value, maximum number of copies which can be printed with the respective replaceable module (belt 210) or maximum pixel usage, and the cumulative value which varies as a function of the usage of the CRU and which generally represents the current status of belt 210, with respect to the end of life parameter. For example, the stored cumulative value may be the print count ("$K_{prints}$") the number of copies/prints that have been created with the belt, periodically updated through a machine controller. The paper weight can also be automated through a paper weight sensor such as described in U.S. Pat. No. 5,138,178 (Wang et al.), the content of which is hereby incorporated by reference.

Controller 310 uses a lookup table 360 having

Exemplary lookup table 360 maintains increment rate 365 for stripping shoe 240 positions in a non-volatile memory ("NVM"). The shown increment rate 365 illustrates the relationship between the second nip widths ($N_2$) as a function of print count. It is noted that the increment rate 365 can also be based on print weight, coating of the media such as uncoated or coated, belt characteristics such as stiffness and age, and a combination of all of the above parameters.

Further, lookup table 360 correlates a second nip width to a cumulative number of belt and media characteristics such as belt degradation, media weight, and media coating to the second nip width, and may be based on empirical testing of self-stripping latitude performance at various stages of wear. For example, at zero ("0") wear like when the belt is first installed, the target second nip width could be 12 mm and the stripping shoe 240 is moved to create the 12 mm nip width. Alternatively, a formula may be constructed, typically assuming a linear wear characteristic, and also based on empirical testing of self-stripping latitude performance at various stages of wear. The build-up of the lookup table is disclosed in greater details in FIG. 6 since in some accounts the belt wear (contamination) may not be as bad as other accounts, so the increment rate could be different.

The controller 310 refers to the lookup table 360, or implements an algorithm such as a formula, to determine the appropriate target second nip width for belt roll system. The results of the formula are saved in a lookup table to be used by the controller when needed. It is foreseeable that multiple lookup tables are maintained based on formulas based on a permutation of belt degradation, media weight, media coating, and type of developer. The controller 310 then controls the stripping shoe 240 to achieve the target position. This gradual movement of the shoe compensates for changes in self-stripping latitude due to paper weight and belt wear, and to promote or minimize the use of stripping devices, or at least to minimize the amount of force required by the stripping devices. Designers of the fusing system can balance the improved self-stripping capability against any decrease in belt life for the short high-strain-energy durations, or potential damage, or other negative effects, arising from an inability to self-strip substrate from the fuser roll.

Figure 4:
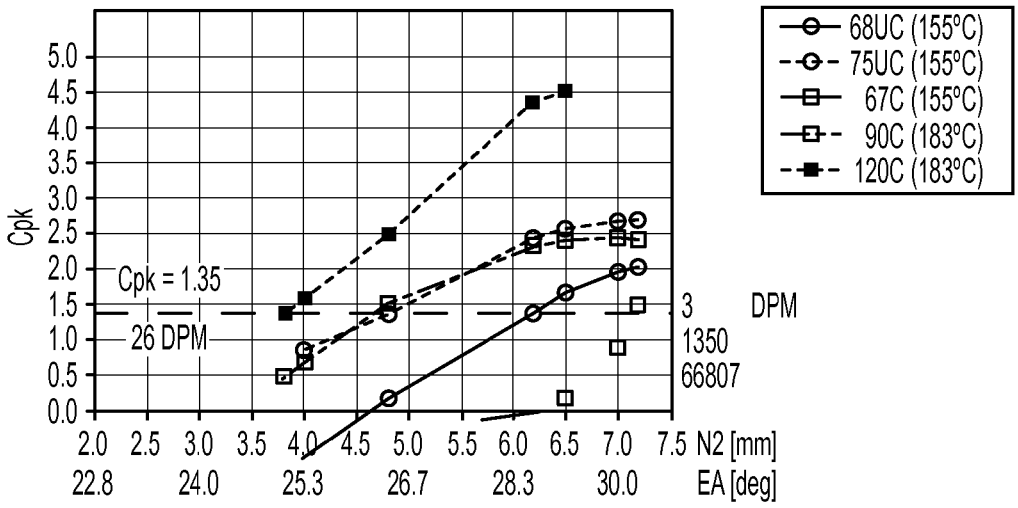
FIG. 4 shows curves illustrating the relationship between the loss of latitude as paper weight decreases from 120 gsm down to 68 gsm in accordance to an embodiment.

FIG. 4 shows curves illustrating the relationship between the loss of latitude as paper weight decreases from 120 gsm down to 68 gsm in accordance to an embodiment. FIG. 4 shows the loss of latitude as paper decreases from 120 gsm down to 68 gsm. As shown the more lightweight the paper, the more slope or the higher elevation angle ("EA") is required for increasing second width N2. In addition to paper weight, coating has an effect on the self-stripping latitude. Uncoated media has more latitude than coated media.

Figure 5:
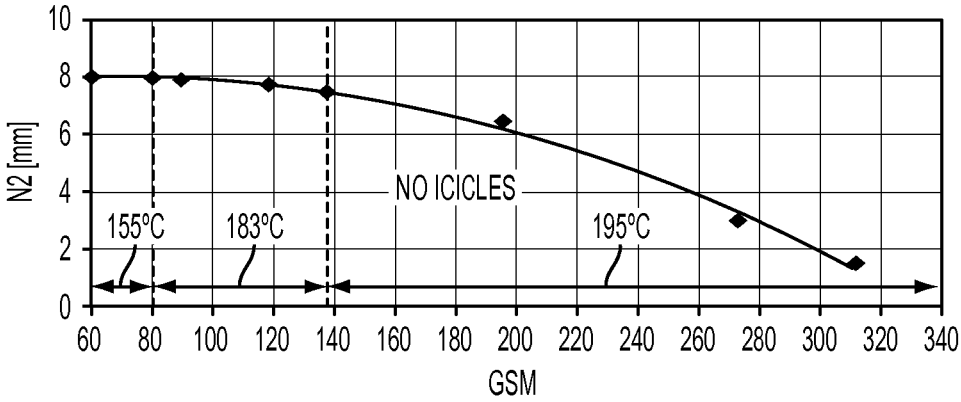
FIG. 5 illustrates the relationship between icicles defect, paper weight, and a second nip width (N2) in accordance to an embodiment.

FIG. 5 illustrates the relationship between icicles defect, paper weight, and a second nip width ($N_2$) in accordance to an embodiment. FIG. 5 shows that in order to have latitude for the icicles defect for the full range of gsm (67-300 gsm) the $N_2$ should be limited to 1 mm but for media below 140 gsm $N_2$ can be as high as 12 mm. A bipolar approach, i.e. a strategy where two fixed shoe positions at a first $N_2$ (2 mm) or at a second $N_2$ (7 mm) in combination with an air knife to recover the stripping latitude, will only be useful when there is a lack of stripping on media 140 gsm or lower. A controller applying an algorithm to incrementally move the stripping shoe like the one described here could use the extra latitude to the icicle defect to increase $N_2$ automatically above $N_2$=2 mm for media 140 gsm or lower. As can be seen in FIG. 4, the stripping robustness increases (CPK increases) for 67 gsm coated media and when coupled with the reduction due to belt age or print count a higher air knife pressure is required to strip the media. FIG. 4 further illustrates how the by just increasing $N_2$ the stripping latitude can be recovered as well.

Figure 6:
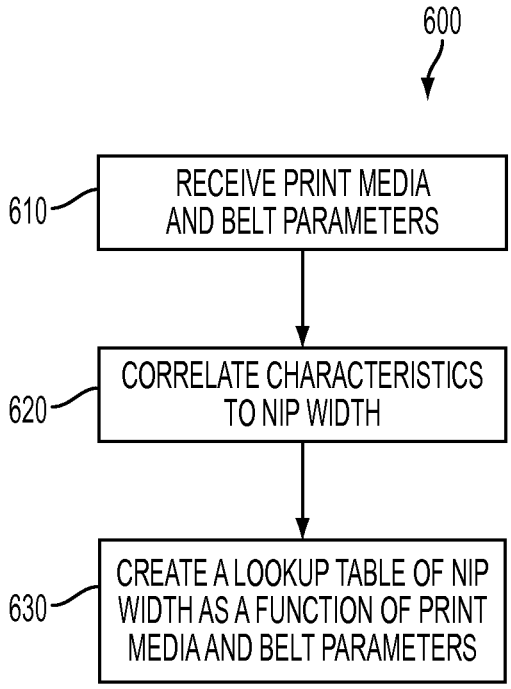
FIG. 6 illustrates a flowchart of a method for populating a lookup table as a function print media and belt parameters in accordance to an embodiment.

FIG. 6 illustrates a flowchart of a method 600 for populating a lookup table as a function print media and belt parameters in accordance to an embodiment. Method 600 begins with action 610. In action 610 the parameter of the print media and belt are received. Print media parameter are coated or uncoated, a numerical value indicative of the weight of the print media, or other media properties that have an impact on self-stripping latitude. Belt parameters can comprise age of the belt such as the number of prints, material of the belt, or a measure of the ability of the belt to maintain a second nip width ($N_2$) as measured with respect to the coefficient of friction (COF) of belt 210 and pressure roll 244. Control is passed to action 620 for further processing. In action 620, method 600 correlates print media parameter and belt parameter to a second nip width ($N_2$). It is noted that the greater the secondary $N_2$, the greater the self-stripping latitude. Further, an increase in secondary nip width ($N_2$) results from an increase strip shoe location or position. Control is then passed to action 630 for further processing. In action, a lookup table is created based on the parameters. The lookup table is an array or associative array which provides the processor savings in terms of processing time since retrieving a value from memory is often faster than undergoing a computation or input/output operation. The values in the lookup table are increment rates that ensure stripping latitude based on belt age, paper weight, coating of the media such as coated or uncoated, or a combination of these variables. The controller selects the increment rate and moves the striping shoe with each print count by the selected rate to ensure that the stripping latitude is maintained. Print media parameters and belt parameters or a combination thereof are represented in columns, while the row is the second nip width. For example, assuming a range of 7 mm (12 mm-1 mm) for a second nip width as shown in FIG. 5 and assuming a maximum belt age of 100 kprints. In order to maintain the self-stripping latitude due to belt aging the stripping shoe should be incremented at a rate of 0.07 mm/kprints. However, when lightweight and middleweight paper (less than 140 gsm) is being processed then rate should be increased either by some multiple or by some fixed value to compensate for the loss self-stripping latitude. For heavyweight paper (greater than 140 gsm) the increment should stay or revert back to the original 0.07 mm/kprints. Uncoated media has more latitude than coated media so the increment rate would be same as heavyweight paper. It should be noted that increment rates could be continuously calculated and a lookup table could be generated on the fly with executable instruction that contain a number of numerical constants which are tied to belt aging rate, temperature and humidity, print media weight, and media coating.

Figure 7:
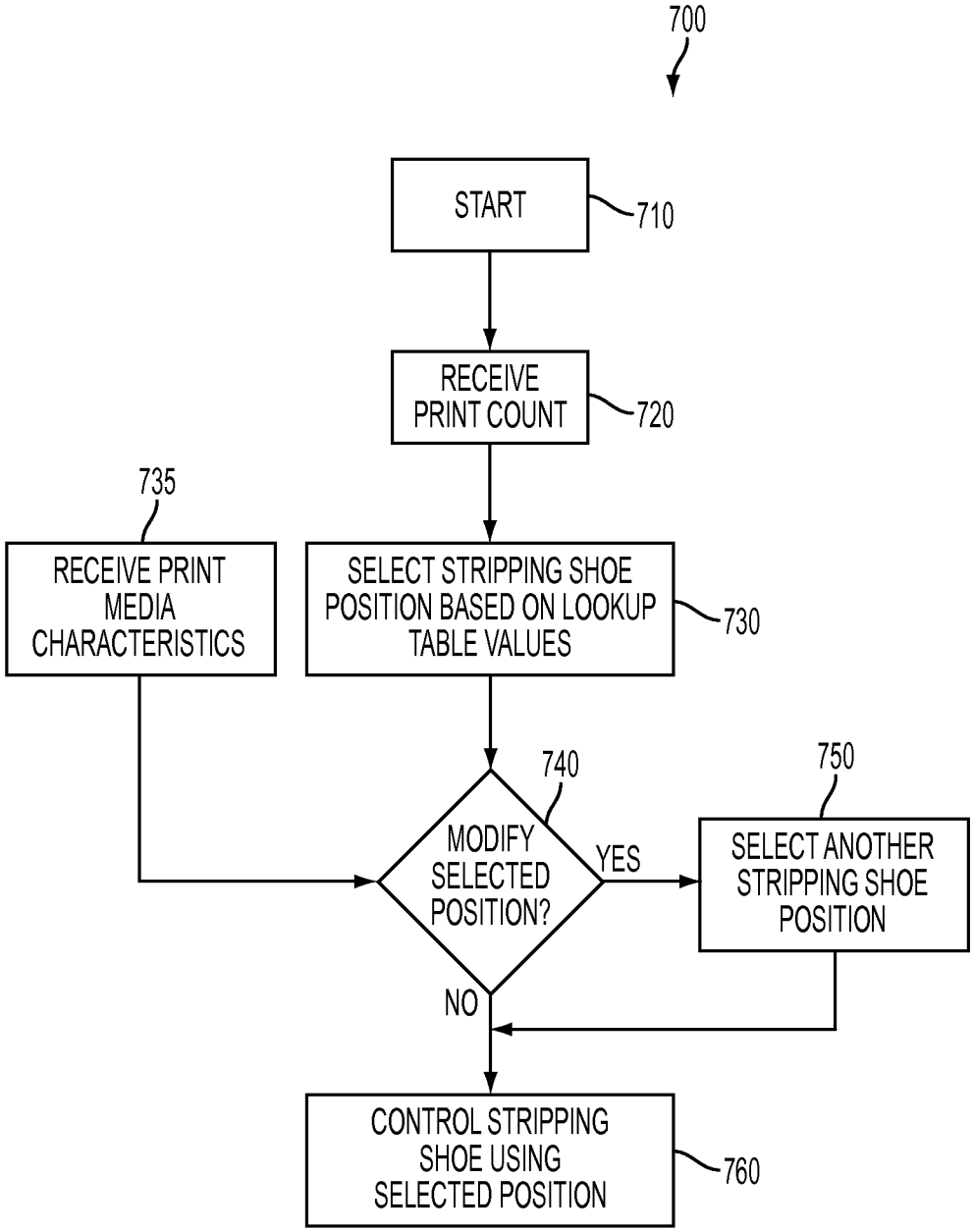
FIG. 7 illustrates a flowchart of a method for improving self stripping latitude associated with fusing members in a printing system in accordance to an embodiment.

FIG. 7 illustrates a flowchart of a method for improving self stripping latitude associated with fusing members in a printing system in accordance to an embodiment. The start 710 invokes method for self-stripping s media from a surface in a printing system. Control is then passed to action 720 where a print count is received from a storage device. The print count can be used by method 700 to determine belt age or belt life by employing well known techniques. Control is then passed to action 730 so a stripping shoe position can be selected. Action 730, selects stripping shoe position based on lookup table values. As noted earlier the lookup table values are an increment rate which translates into a change of position for the stripping shoe 240. This change in position moves the stripping shoe 240 towards the first nip and causes an increase of the second nip ($N_2$) due to a change in the position of the position of belt 210. A change in belt position affects the wrap angle with external pressure roll 244 and the stripping angle. Positioning the stripping shoe improves the stripping latitude and print quality by eliminating icicles for all sheets as a function of at least media weight and belt age. Control is then passed to action 740 for further processing. In action 740, it is determined if the selected position form action ought to be modified. As noted above with reference to FIG. 4 and FIG. 6, the values (increment rates) in the lookup table can be modified based on the media being processed. In action 735 the print media characteristics received from a system process such as sensor that can determine weight or from an input provided by a user through an interface as described in FIG. 2. If print media characteristics need to be processed control is passed to action 750 for further processing. In action 750, another shoe position is selected in accordance to the received print media characteristic. For example, paper of less than 140 gsm lack the self-stripping latitude and would require a more aggressive increment rate or a more aggressive position of the stripping shoe. Uncoated media and higher paper weight (≤140 gs) have more latitude than coated media and would require the modification of action 750. In action 760, the stripping position selected at action 730 or at action 750 is used to move the stripping shoe 240 to a position that improves the self-stripping latitude.

Figure 8:
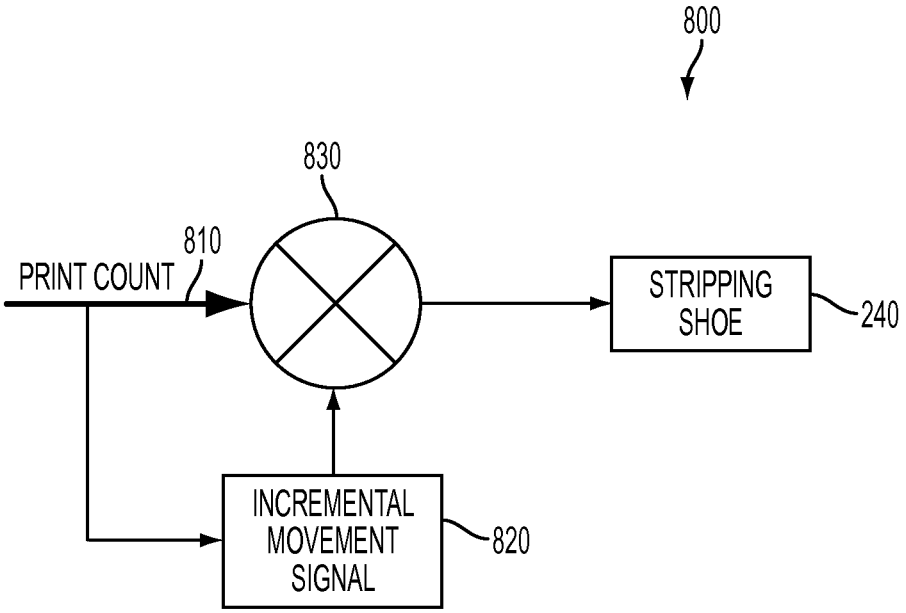
FIG. 8 is a block diagram of a circuit for improving self-stripping latitude associated with fusing members in a printing system in accordance to an embodiment.

FIG. 8 is a block diagram of a circuit 800 for improving self stripping latitude associated with fusing members in a printing system in accordance to an embodiment.

The circuit 800 comprises a motor 830, a signal device 820 for generating an increment rate as a function of print count, and a stripping shoe 240. the motor 830 can be operated in a step-wise manner to allow the stripping shoe 240 to be moved to positions between the fully-extended and fully-retracted position which coincides with second nip width of between 1 mm and 12 mm. For example, after heavy-weight media (G.T. 140 gsm) have been run in the fuser system using a lower applied pressure at the second nip (N2), to then run light-weight media (L.T. 76 gsm), the pressure at the second nip can be increased by moving the stripping shoe 240 toward the first nip 204 by step-wise operation of the motor 830. The print count 819 signal operates the motor step-wise manner to compensate for belt degradation mainly to belt age. When factors such as print weight and coating of the print media are introduced a modification of the increment rate is performed at signal device 820. The signal device 820 produces an incremental movement signal that is a product of print media characteristics and print count, and a cancellation signal that removes the original print count signal 810 since it part of the product.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

The described embodiments enable increased paper per minute productivity because of the improved self-stripping provided by concepts of the present disclosure and, at the same time, provide for wide latitude with respect to the types of substrate media which will successfully be fused, e.g., thinner paper sheets. Further, these advantages have been achieved with minimal increase in strain energy, thereby reducing any undesirable side effects.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A fusing system useful in a printing apparatus, comprising:

a first member including a first outer surface;

a second member including a second outer surface;

a belt including an inner surface and an outer surface, wherein a first nip having a first nip width is formed by contact between the inner surface of the belt and the first outer surface and contact between the outer surface of the belt and the second outer surface;

a stripping mechanism comprising a stripping shoe disposed internal to the belt, wherein the stripping shoe is positionable relative to the first nip to vary contact between the outer surface of the belt against the second outer surface downstream from the first nip, wherein media are stripped from the belt after exiting from the first nip and wherein the contact between the outer surface of the belt against the second outer surface forms a second nip width adjacent to the first nip; and a controller, having a storage device that stores information and instructions for execution by a processor, to incrementally move the stripping shoe to adjust the contact between the outer surface of the belt against the second outer surface downstream from the first nip so as to compensate for at least one of belt degradation, media weight, and media coating;

wherein the incremental movement of the stripping shoe changes the second nip width to improve self-stripping latitude.

2. The fusing system according to claim 1, wherein the processor uses a lookup table with values that correlate the at least one of belt degradation, media weight, and media coating to the second nip width.

3. The fusing system according to claim 2, wherein the first nip includes an inlet where media enter the first nip and an outlet where the media exit the first nip.

4. The fusing system according to claim 3, wherein the second nip width formed by the stripping shoe is adjacent to the outlet of the first nip.

5. The fusing system according to claim 4, wherein the second nip width is adjusted within a range of about 1 mm to about 12 mm.

6. The fusing system according to claim 5, wherein the incremental movement of the stripping shoe is increased for media weight lower than a predetermined media weight and decreased for uncoated media.

7. The fusing system according to claim 4, wherein the controller receives signals from a sensor that detects media weight and media coating to move the stripping shoe from a first position to a second position according to the lookup table.

8. A method of stripping media from a surface in a printing system, comprising:

feeding a medium having marking material thereon to a first nip, the first nip being formed by a first surface of a first member and an inner surface of a belt rotatably supported on a second surface of a second member, the medium contacting the second surface and the outer surface of the belt at the first nip;

adjusting by using a controller and stripping shoe a second nip width formed adjacent to the first nip by contact between the outer surface of the belt against the second outer surface, wherein the adjustment moves the stripping shoe towards the first nip so as to compensate for at least one of belt degradation, media weight, and media coating; and selectively changing the second nip width in response to a defined signal from the controller having a storage device that stores information and instructions for execution by a processor;

wherein changing the second nip width improves self-stripping latitude.

9. The method according to claim 8, wherein the processor uses a lookup table with values that correlate the at least one of belt degradation, media weight, and media coating to the second nip width.

10. The method according to claim 9, wherein the first nip includes an inlet where media enter the first nip and an outlet where the media exit the first nip.

11. The method according to claim 10, wherein the second nip width formed by the stripping shoe is adjacent to the outlet of the first nip.

12. The method according to claim 9, wherein the controller receives signals from a sensor that detects media weight and media coating to move the stripping shoe from a first position to a second position according to the lookup table.

13. The method according to claim 12, wherein the second nip width is adjusted within a range of about 1 mm to about 12 mm.

14. The method according to claim 13, wherein the incremental movement of the stripping shoe is increased for media weight lower than a predetermined media weight and decreased for uncoated media.

15. An apparatus useful for printing, comprising:

a first pressure roll including a first outer surface;

a second pressure roll including a second outer surface;

a heated belt including an inner surface and an outer surface;

a first nip formed by contact between the outer surface of the belt and the second outer surface and contact between the inner surface of the belt and the first outer surface, the first nip including an inlet where media enter the first nip and an outlet where the media exit the first nip; and a stripping mechanism comprising:

a motor;

a stripping shoe connected to the motor and disposed internal to the belt, wherein the motor is operable to position the stripping shoe relative to the first nip to vary contact between the outer surface of the belt against the second outer surface downstream from the outlet of the first nip, wherein the contact between the outer surface of the belt against the second outer surface forms a second nip width adjacent to the first nip; and a controller, having a storage device that stores information and instructions for execution by a processor, to selectively control the motor using stored information that relate to belt and media properties to incrementally move the stripping shoe to adjust the contact between the outer surface of the belt against the second outer surface downstream from the first nip.

16. The apparatus according to claim 15, wherein the stored information is a lookup table with values that correlate the at least one of belt degradation, media weight, and media coating to the second nip width.

17. The apparatus according to claim 16, wherein the first nip includes an inlet where media enter the first nip and an outlet where the media exit the first nip.

18. The apparatus according to claim 17, wherein the second nip width is adjusted within a range of about 1 mm to about 12 mm.

19. The apparatus according to claim 18, wherein the incremental movement of the stripping shoe is increased for media weight lower than a predetermined media weight and decreased for uncoated media.

20. The apparatus according to claim 18, wherein the controller receives signals from a sensor that detects media weight and media coating to move the stripping shoe from a first position to a second position according to the lookup table.

* * * * *